United States Patent [19]

Ehrhardt

[11] Patent Number: 5,027,097

[45] Date of Patent: Jun. 25, 1991

[54] SADDLE-COIL ARRANGEMENT FOR A CATHODE RAY TUBE AND A COIL CARRIER FOR SUCH AN ARRANGEMENT

[75] Inventor: Andreas Ehrhardt, Plochingen, Fed. Rep. of Germany

[73] Assignee: Nokia Unterhaltungselektronik, Pforzheim, Fed. Rep. of Germany

[21] Appl. No.: 542,705

[22] Filed: Jun. 22, 1990

[30] Foreign Application Priority Data

Jun. 24, 1989 [DE] Fed. Rep. of Germany ..... 3920699

[51] Int. Cl.[5] ..... H01F 5/00

[52] U.S. Cl. ..... 335/213; 335/210; 313/428

[58] Field of Search ..... 335/210, 213; 313/421, 313/426, 428

[56] References Cited

U.S. PATENT DOCUMENTS

| | | | |
|---|---|---|---|
| 4,260,974 | 4/1981 | Nelle | 335/213 |
| 4,484,166 | 11/1984 | Osinga et al. | 335/213 |
| 4,712,080 | 12/1987 | Katou | 335/213 |
| 4,786,838 | 11/1988 | Meershoe et al. | 335/213 X |

FOREIGN PATENT DOCUMENTS

| | | | |
|---|---|---|---|
| 61-66347 | 4/1986 | Japan | 335/213 |

*Primary Examiner*—George Harris

*Attorney, Agent, or Firm*—Peter C. Van Der Sluys

[57] ABSTRACT

A coil-carrier half (11) for a saddle-coil arrangement for a cathode ray tube accomodates a saddle-coil winding, in a front groove (13), a rear groove (14), left slots (18.11–18.51) and right slots. Prolongation of the left slots in comparison with the right slots results from the presence. in a rear wall (15.h) of a front-groove, at the positions where the left slots open out into the groove, of steps which are greater towards the front than at the fan-out positions of the right slots.

In an asymmetrically built coil-carrier half of this sort, turns (12)' are introduced in each slot so that they run towards the prolongation position of the slot. This produces a saddle-coil arrangement which leads to fewer image defects than when a conventional saddle-coil arrangement with symmetrical coil-carrier halves is used.

6 Claims, 4 Drawing Sheets

SADDLE-COIL ARRANGEMENT FOR A CATHODE RAY TUBE AND A COIL CARRIER FOR SUCH AN ARRANGEMENT

BACKGROUND OF THE INVENTION

1. Field of the Invention

The invention concerns a saddle-coil arrangement for a cathode ray tube, i.e. a saddle-coil arrangement with a funnel-shaped coil carrier made of insulating material which carries two saddle-coil windings. The coil carrier usually consists of two coil-carrier halves. More exactly, the invention concerns coil-carrier halves of this sort and also a saddle-coil arrangement which features two coil-carrier halves, each having a winding. These saddle-coil arrangements are used for the horizontal deflection of the electron beams in a cathode ray tube. In the following, it is assumed that the cathode ray tube is one having several separately controllable electron beams, e.g. a colour picture tube. However, the invention can also be applied to monochrome tubes.

2. Description of the Prior Art

Saddle-coil arrangements with a coil carrier and two single windings are manufactured in two fundamentally different ways. In one process, the single windings are wound around a special shape, then baked and finally attached to the support. In the other process, which is solely concerned here, each single winding is wound directly onto a coil-carrier half and the two wound coil-carrier halves are assembled to form the saddle-coil arrangement. Coil-carrier halves for arrangements thus built feature the following guide parts for the winding:

- a front groove at the front, wider diameter of the funnel-shaped carrier half,
- a rear groove at the rear, narrower diameter of the carrier half,
- several left slots which connect the two grooves near their left ends, and
- several right slots which connect the two grooves near their right ends and which lie in angular symmetry with the left slots.

When inserting the winding wires into the slots, winding starts, for example, at the rear groove and then the wire passes into the first right slot (viewed from the front for the lower carrier half) until it reaches the front groove. In the front groove it passes from the right to the left until the first left slot is reached. In this slot it then passes to the rear and there it passes from the left to the right in the rear groove. In most cases, several wires are introduced at the same time, e.g. four wires, each with a diameter of 0.375 mm. When the required total number of windings, e.g. 10 windings, each consisting of four wires, are inserted into the first slots, the second slots are supplied with windings, etc. In saddle coils used for the above-mentioned purpose, there are normally 4–6 slots on each side of a coil-carrier half.

As a result of the winding technique used and for reasons of space, the winding is manufactured by routing the wire at different points and drawing it at different forces. When the wire is passed from a slot to a groove the wire can be easily maintained on the bottom surface of the slot; however, when the wire is passed from a groove to a slot the winding technique causes the wire to lie on previously-wound wire, thereby effectively making the slot longer at a groove-to-slot junction, producing asymmetrical windings which lead to image defects. These image defects are represented in an exaggerated form in FIG. 5a. In FIG. 5a it is assumed that three horizontal white lines should be presented on a screen 10, i.e. one in the centre and one at both the bottom and top of the screen. Each white line is composed of a red line r, a green line g and a blue line b. Ideally, these lines should be superimposed across the total width of the screen. However, with previous conventional saddle-coil arrangements, i.e. arrangements with windings wound directly onto a coil carrier, the systematic image defects according to FIG. 5a occur. The three coloured single lines at the top and bottom of the screen each spread outwards at increasing and unequal distances from the horizontal to one side of the screen. The central white line is split into its three composite colour single lines at its ends near the edges of the screen (twist).

Efforts have been made to reduce the systematic defects illustrated by means of FIG. 5a as much as possible by assuring that the winding forces exerted when the windings are manufactured are as constant as possible. However, residual defects proved to be unavoidable.

The problem of reducing the described image defects still further has therefore existed for many years.

SUMMARY OF THE INVENTION

It was discovered that the aforementioned image defects can be almost totally avoided by using asymmetrically built coil-carrier halves for the saddle-coil arrangement. Slots which are arranged in angular symmetry to each other are no longer of the same length. The length of at least one right slot is different from the length of a left slot with which it lies in angular symmetry. A saddle-coil arrangement according to the invention uses such coil-carrier halves according to the invention.

The invention thus represents an approach which is in total contradiction to previous efforts. Said efforts were aimed at achieving the best possible symmetry in the coil carrier and during the winding process. In the invention the symmetry of the coil-carrier halves is deliberately upset by prolonging the slot length at a coil-carrier side where the wire travels from a slot to a groove to compensate for the effective slot elongation that takes place on the other side, where the wire effectively piles up. Each winding is wound so that it runs in a slot as far as the prolongation position of the slot. The asymmetrical coil-carrier design permits the almost complete compensation of asymmetries which result during the winding process due to the fact that at one end of the groove windings enter the groove from slots, whereas at the other end, they enter slots from a groove.

Slots are preferably lengthened by displacing the rear wall of the front-groove, where the slots intersect the groove, closer to the front than the position of the rear wall of the front-groove at the slots which are not lengthened.

DETAILED DESCRIPTION OF THE PREFERRED EMBODIMENT

Figure 1:
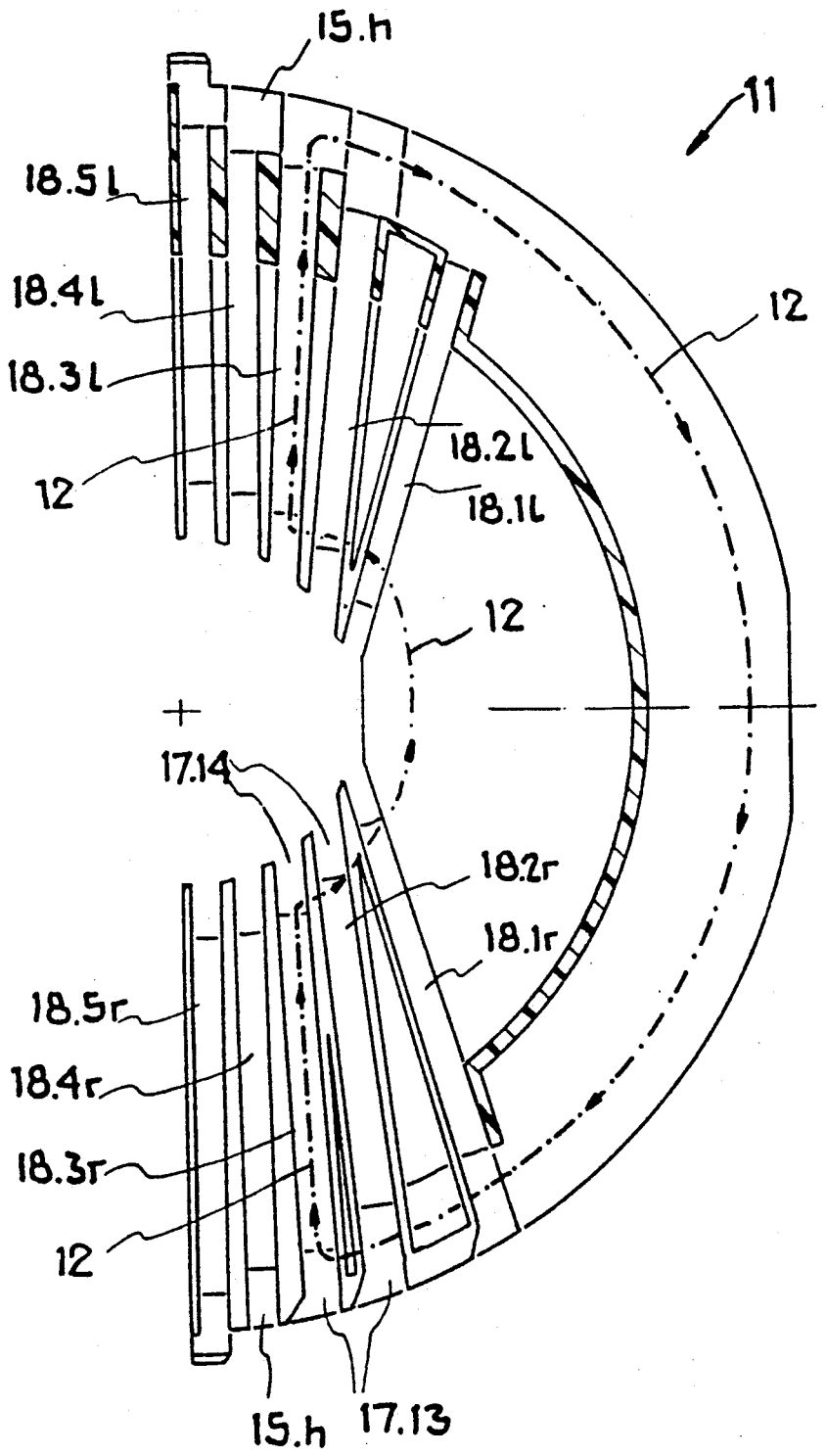
FIG. 1 is a front view of a coil-carrier half shown in partial section.
Figure 2:
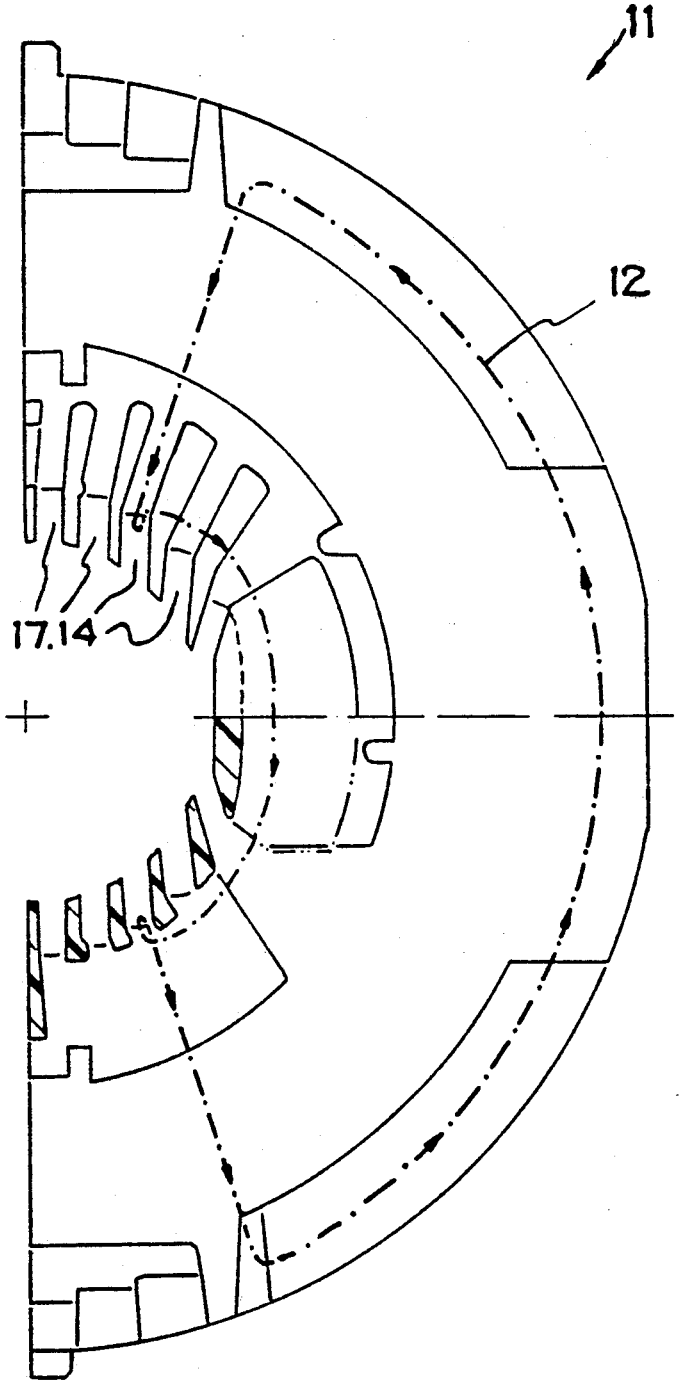
FIG. 2 is a rear view of the coil-carrier half according to FIG. 1 shown in partial section.

FIGS. 1–4 show a coil-carrier half 11 of a coil carrier for a saddle-coil arrangement for a cathode ray tube. The entire saddle-coil arrangement consists of two coil-carrier halves of this sort, each carrying a saddle-coil winding. A single turn 12 of a winding of this sort is depicted by dashed lines in FIGS. 1–4. The total structure of a winding corresponds to the conventional structure explained above.

The coil-carrier half 11 according to the figures is designed in the shape of a funnel, with a front groove 13 at the front having a greater diameter than a rear groove 14. The front groove 13 is defined by a front wall **15.*v* and a rear wall 15.*h*. Similarly, the rear groove 14 is defined by a front wall 1b.*v* and a rear wall 1b.*h*. There are slits 17.13 in the rear wall 15.*h*, and the front wall 16.*v* has related slits 17.14**. Slots intersect the grooves at the positions of these. The l and r designations refer to beam deflection directions relative to the direction of travel of the beam.

The turn 12 depicted in the figures runs in the rear groove 14 in a counterclockwise direction when the half is viewed from the front, then passes through a slit 17.14 into the third left slot 18.31 and enters the front groove 13 via a slit 17.13. In this groove it passes, in a clockwise direction, to the slit in which the third right slot **18.3*r* fans out. Via this slot and the corresponding slit 17.14 in the front wall 16.*v* of the rear groove, the wire re-enters the rear groove 14** and thus arrives at the outlet point.

Figure 3:
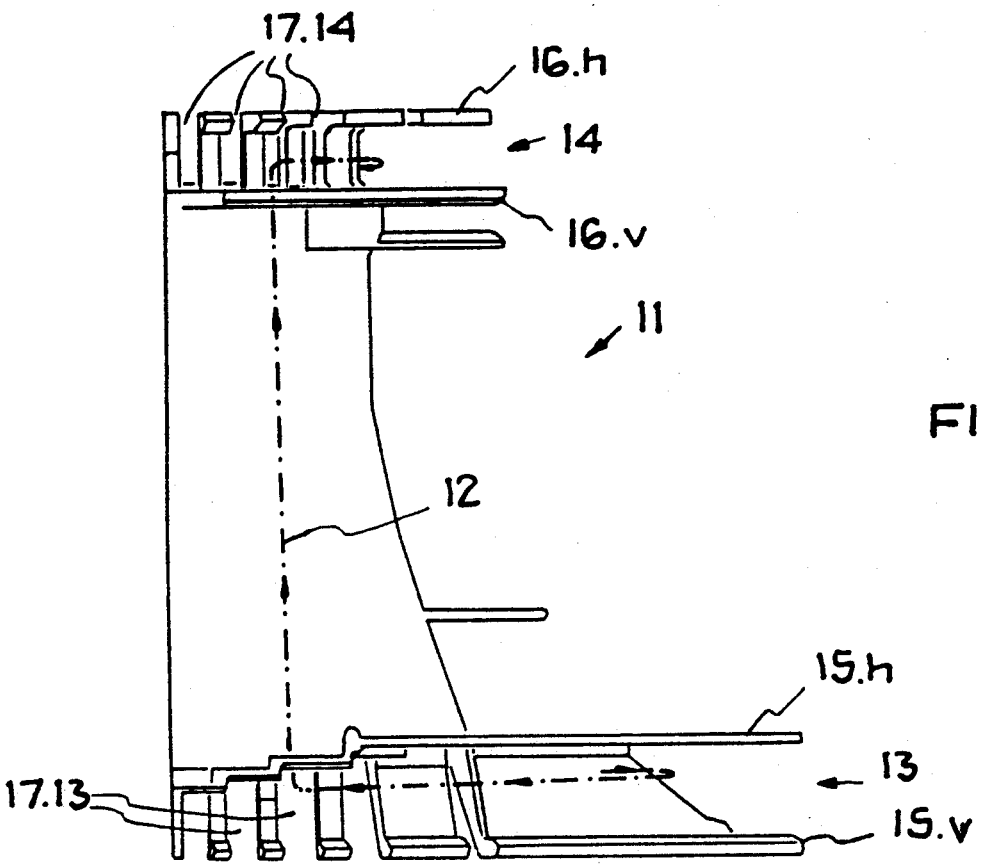
FIG. 3 is a side view of the coil-carrier half according to FIGS. 1 and 2 from the side on which higher steps in the rear wall of the front groove ensure different slot lengths.
Figure 4:
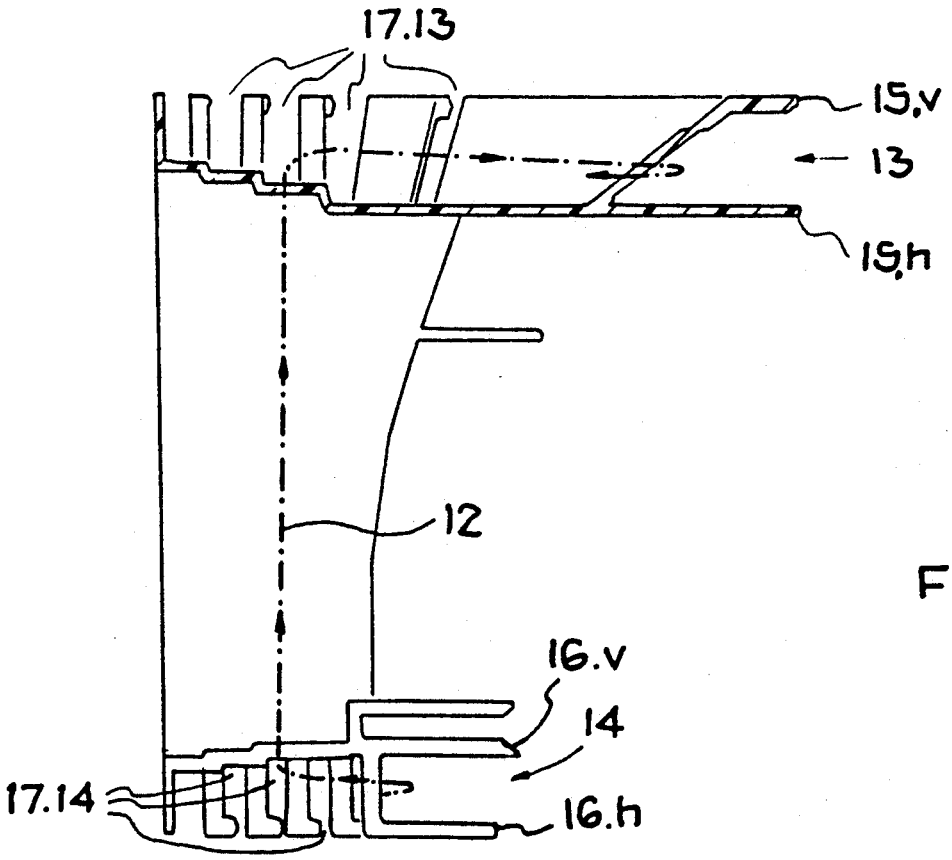
FIG. 4 is a side view corresponding to that of FIG. 3, but from the side in which steps in the front wall of the rear groove ensure prolongation of the slots.
Figure 5A:
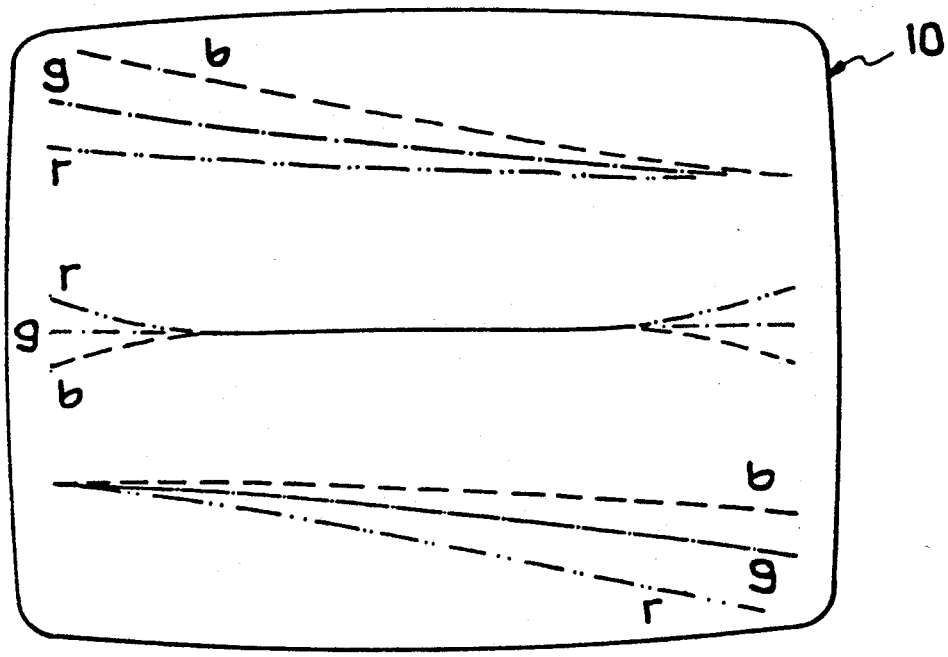
FIG. 5*a* is a schematic, highly exaggerated representation of image defects resulting from the use of a saddle-coil arrangement on conventional coil-carrier halves.
Figure 5B:
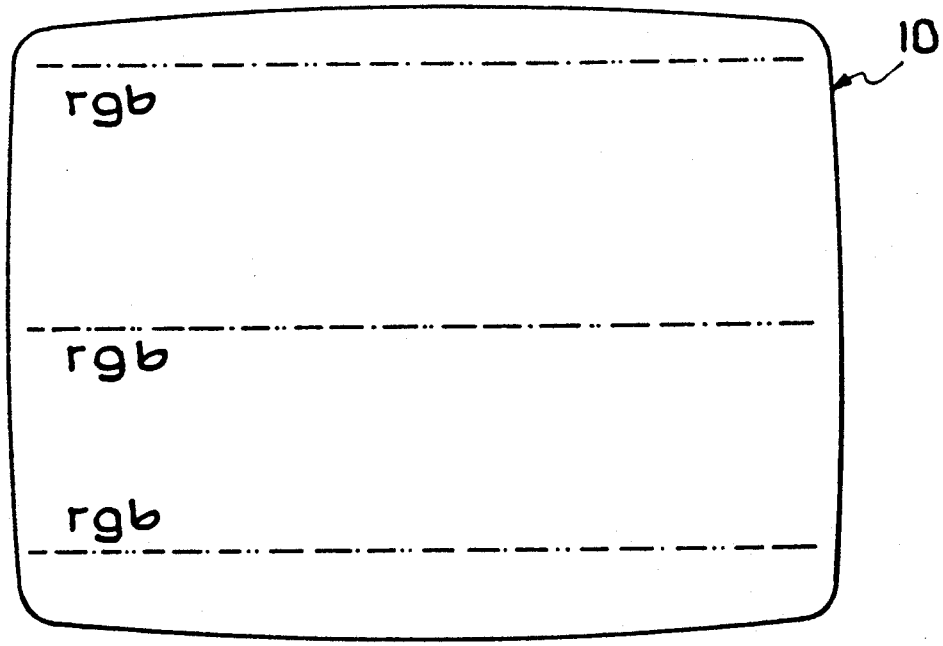
FIG. 5*b* is a representation corresponding to that of FIG. 5*a*, but for a saddle-coil arrangement with asymmetrical coil-carrier halves.

In the side views of FIGS. 3 and 4, it can be seen that the rear wall **15.*h* of the front-groove is stepped in such a way that, at the positions of different slits 17.13, it lies at different distances from the front, this distance being smaller the closer a slit is to the horizontal end of the coil-carrier half 11. This type of stepping is known from the state of the art. However, it is of special importance for the coil carrier presented that the step height at the location of the left slots 18.2*l*–18.5*l* is greater than at the location of the right slots 18.2*r*–18.5*r*. As a result, the aforementioned left slots are longer than the aforementioned corresponding right slots. Only the first slots on the right and left, i.e. the slots 18.1*l* and 18.1*r*** are of the same length.

In FIGS. 3 and 4, it can also be seen that, for the fourth and fifth slots on the right, i.e. slots **18.4*r* and 18.5*r*, the front wall 16.*v* of the rear groove is increasingly displaced in steps towards the rear. On the other hand, the front wall 16.*v* of the rear groove is without steps on the left side. The backward steps on the right side have the effect of partially and not completely cancelling out the prolongations which were achieved by the different steps in the rear wall 15.*h* of the front groove, for left slots 18.4*l* and 18.5*l* in comparison with the corresponding right slots. This is because the step differences in the rear wall 15.*h* of the front groove are greater than the step differences in the front wall 16.*v* of the rear groove. In an application example, the step difference for corresponding slots on the left and right at the rear wall 15.*h* of the front groove was 1 mm, whereas it was only 0.5 mm for the front wall 16.*v*** of the rear groove.

In the application example, the four slots **18.2*l*–18.5*l* are therefore lengthened at the location of the rear wall 15.*h* of front groove in comparison with the corresponding right slots 18.2*r*–18.5*r*. But there is also a prolongation for the right slots 18.4*r* and 18.5*r*, not at the side of the rear wall 15.*h* of the front-groove, however, but at the side of the front wall 16.*v* of the rear groove. In a coil-carrier half with this design, turns are introduced into slots and grooves as explained above with reference to turn 12**, i.e. so that wire in the slots runs in the direction towards the prolongation position in each case.

Saddle-coil arrangements with coil-carrier halves according to FIGS. 1–4 can be used in all types of cathode ray tubes. It depends on the specific application whether all or only some slots must be lengthened and whether prolongations are required at the front as well as the rear. Experience has shown the prolongation produces the greatest effects at the front. The number of slots used and the number of turns introduced also depends on the application.

For all variations, it is essential that the length of at least one right slot is different from the length of the left slot with which it lies in angular symmetry. For saddle-coil arrangements including such coil carriers, it is essential for the windings to be positioned in such a way that they run in the slot in the direction towards of the prolongation position of the slot.

I claim:

1. A coil-carrier half for a saddle coil for a cathode ray tube, said coil carrier half having a funnel shape with a wider diameter at a front than at a rear end thereof, comprising:

a front groove (13) at the front;

a rear groove (14) at the rear;

several left slots (**18.1*l*–18.5*l*) which connect the front and rear grooves near the left ends of the grooves; and several right slots (18.1*r*–18.5*r*) which connect the front and rear grooves near the right ends, and which lie in angular symmetry with the left slots, the length of at least one right slot (189.2*r*–18.5*r*) is different from the length of the left slot (18.2*l*–18.5*l***) lying in angular symmetry with it.

2. A coil-carrier half according to claim 1, characterized in that the rear wall (**15.*h*) of the front-groove at the respective flaring points of the slots (18.1*l*–18.5*l*, 18.1*r*–18.5*r***) lies at different distances to the rear.

3. A coil-carrier half according to claim 1, characterized in that the wall (**16.*v*) of the front rear-groove at the respective flaring points of the slots (18.1*l*–18.5*l*, 18.1*r*–18.5*r***) lies at different distances to the front.

4. Saddle coil arrangement for a cathode ray tube comprising a funnel-shaped coil carrier composed of two halves (11), and a winding (12) on each coil-carrier half, characterized in that each coil-carrier half (11) is designed according to claim 1, and each winding is positioned so that its turns (12) run in a slot towards the prolongation point of the slot (18.2*l*–18.5*l*, 18.4*r* and 18.5*r*).

5. A saddle coil arrangement for a cathode ray tube, comprising:

a funnel-shaped coil carrier composed of two halves (11); and a winding (12) on each coil-carrier half, characterized in that each coil-carrier half (11) is designed according to claim 2, and each winding is positioned so that its turns (12) run in a slot towards the prolongation point of the slot (18.2*l*–18.5*l*, 18.4*r* and 18.5*r*).

6. A saddle coil arrangement for a cathode ray tube, comprising:

a funnel-shaped coil carrier composed of two halves (11); and a winding (12) on each coil-carrier half, characterized in that each coil-carrier half (11) is designed according to claim 3, and each winding is positioned so that its turns (12) run in a slot towards the prolongation point of the slot (18.2*l*–18.5*l*, 18.4*r* and 18.5*r*).

* * * * *

UNITED STATES PATENT AND TRADEMARK OFFICE

CERTIFICATE OF CORRECTION

PATENT NO. : 5,027,097

DATED : June 25, 1991

INVENTOR(S) : Andreas Ehrhardt

It is certified that error appears in the above-identified patent and that said Letters Patent is hereby corrected as shown below:

Column 4:

Claim 3, line 2, after the word 'the' at its first occurrence, please insert --front-- and after the word 'the' at its second occurrence, please delete the word 'front'.

Signed and Sealed this

Tenth Day of November, 1992

*Attest:*

DOUGLAS B. COMER

*Attesting Officer*

*Acting Commissioner of Patents and Trademarks*